US006113775A

United States Patent [19]

Christolini et al.

[11] Patent Number: 6,113,775

[45] **Date of Patent: *Sep. 5, 2000**

[54] SPLIT END HYDROCRACKING PROCESS

[75] Inventors: Ben A. Christolini, Lincolnshire; Donald B. Ackelson, Kildeer, both of Ill.

[73] Assignee: UOP LLC, Des Plaines, Ill.

[ * ] Notice: This patent is subject to a terminal disclaimer.

[21] Appl. No.: 09/196,096

[22] Filed: Nov. 19, 1998

Related U.S. Application Data

[60] Provisional application No. 60/067,470, Dec. 5, 1997.

[51] Int. Cl.[7] ..... C10G 65/18

[52] U.S. Cl. ..... 208/80; 208/78

[58] Field of Search ..... 208/78, 80

[56] References Cited

U.S. PATENT DOCUMENTS

| | | | |
|---|---|---|---|
| 3,240,694 | 3/1966 | Mason et al. | 208/59 |
| 3,243,367 | 3/1966 | Mason et al. | 208/80 |
| 3,260,663 | 7/1966 | Inwood et al. | 208/80 |
| 3,265,610 | 8/1966 | Lavergne et al. | 208/80 |
| 3,267,021 | 8/1966 | Gould | 208/80 |
| 3,429,801 | 2/1969 | Gleim et al. | 208/58 |
| 3,579,435 | 5/1971 | Olenzak et al. | 208/59 |
| 3,649,518 | 3/1972 | Watkins | 208/50 |
| 5,228,979 | 7/1993 | Ward | 208/111 |
| 5,904,835 | 5/1999 | Thakkar | 208/80 |

OTHER PUBLICATIONS

"Hydrocracking Science and Technology", authored by Julius Scherzer and A.J. Gruia published in 1996 by Marcel Dekker.

*Primary Examiner*—Walter D. Griffin

*Attorney, Agent, or Firm*—John G. Tolomei; John F. Spears, Jr.

[57] ABSTRACT

A large difficult to process hydrocracking feed stream may be processed at lower overall pressure and therefore in a unit of reduced capital cost by first dividing the feed stream into a light fraction and a smaller heavy fraction and then processing these fractions in separate reactors. The heavy fraction will normally contain the more difficult to process species and is processed in a once through reaction zone. The light fraction is processed in a higher conversion reaction zone which also receives the recycle stream produced in the product fractionation/recovery zone. The effluents of the two reaction zones may be charged into a common separator or into different separators to reduce ammonia levels in the recycle reactor.

12 Claims, 1 Drawing Sheet

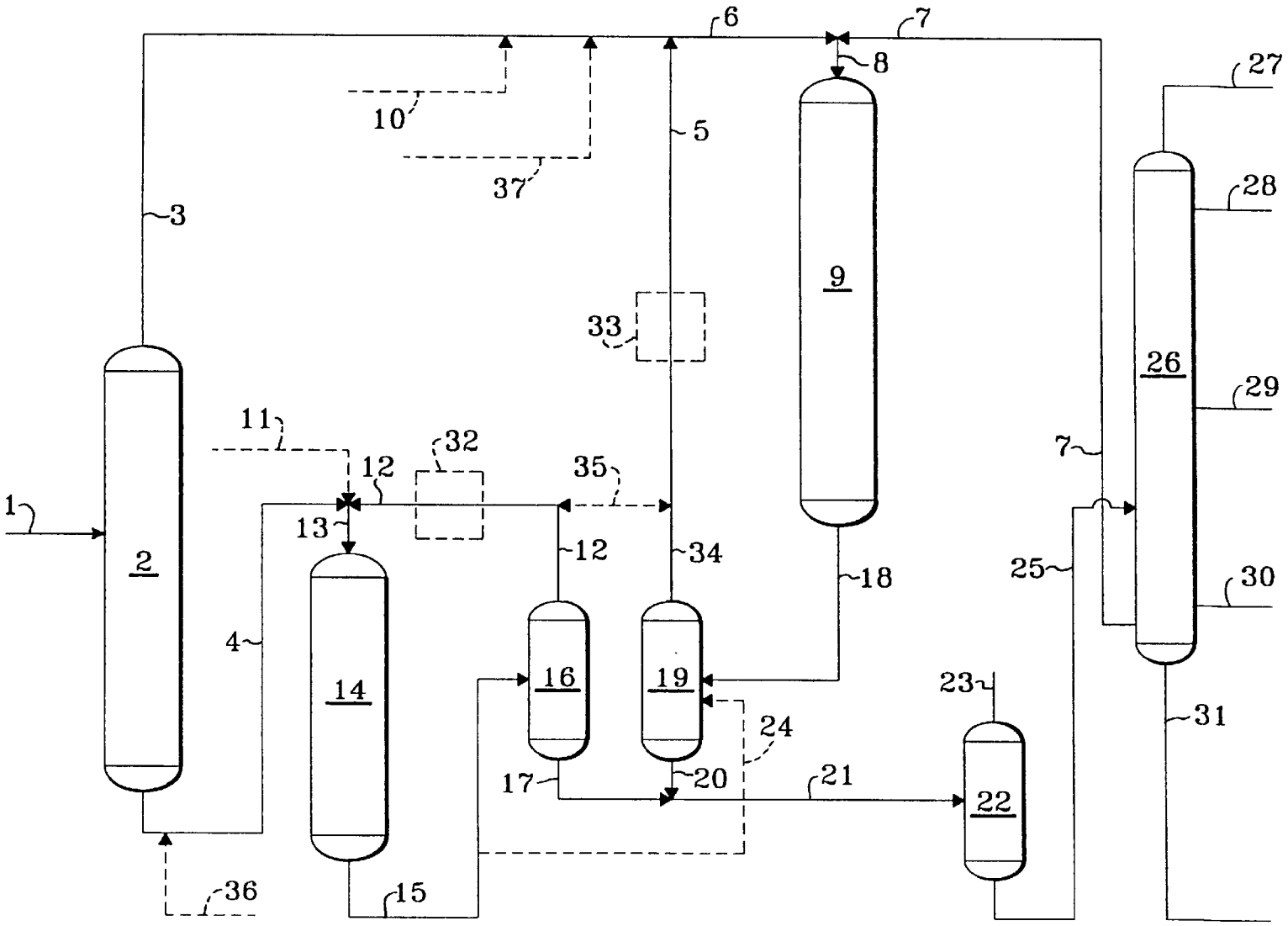
1
2
3
4
5
6
7
8
9
10
11
12
13
14
15
16
17
18
19
20
21
22
23
24
25
26
27
28
29
30
31
32
33
34
35
36
37

SPLIT END HYDROCRACKING PROCESS

This application is related to and claims the benefit of the filing date of provisional application No. 60/067,470 filed Dec. 5, 1997.

FIELD OF THE INVENTION

The invention relates to a hydrocarbon conversion process for use in petroleum refineries. The invention more specifically relates to a novel flow scheme for a hydrocracking process.

RELATED ART

Hydrocracking processes are used commercially in a large number of petroleum refineries. They are used to process a variety of feeds ranging from naphthas to very heavy crude oil residual fractions. In general the hydrocracking process splits the molecules of the feed into smaller (lighter) molecules having higher average volatility and economic value. At the same time a hydrocracking process normally improves the quality of the material being processed by increasing the hydrogen to carbon ratio of the materials, and by removing sulfur and nitrogen. The significant economic utility of the hydrocracking process has resulted in a large amount of developmental effort being devoted to the improvement of the process and to the development of better catalysts for use in the process. A general review and classification of the different hydrocracking process flow schemes is provided in the book entitled, "*Hydrocracking Science and Technology*", authored by Julius Scherzer and A. J. Gruia, published in 1996 by Marcel Dekker, Inc. Specific reference may be made to the chapter beginning at page 174 which describes single stage, once-through and two-stage hydrocracking process flow schemes.

A number of references illustrate the use of multiple hydrocracking zones within an overall hydrocracking unit. The terminology "hydrocracking zones" is employed herein as hydrocracking units often contain several individual reactors. A hydrocracking zone may contain two or more reactors. For instance, U.S. Pat. No. 3,240,694 issued to H. F. Mason et al. illustrates a hydrocracking process in which a feed stream is fed into a fractionation column and divided into a light fraction and a heavy fraction. The light fraction passes through a hydrotreating zone and then into a first hydrocracking zone. The heavy fraction is passed into a second, separate hydrocracking zone, with the effluent of this hydrocracking zone being fractionated in separate fractionation zone to yield a light product fraction, an intermediate fraction which is passed into the first hydrocracking zone and a bottoms fraction which is recycled to the second hydrocracking zone.

U.S. Pat. No. 3,429,801 issued to W. K. T. Gleim et al. illustrates a unique process flow in which the charge stream is alternately passed into one of the two hydrocracking zones in the process, with the other hydrocracking zone serving to process a recycle stream at a lower temperature.

U.S. Pat. No. 3,579,435 issued to A. T. Olenzach et al. illustrates a process in which three different feedstreams are fed to an overall process. Each of the feedstreams is fed into a different hydrocracking zone. The effluent of a first zone flows into the second zone and the effluent of the second zone flows into the third zone. The effluent of the third zone is passed into the product recovery section.

U.S. Pat. No. 3,649,518 assigned to C. H. Watkins illustrates a hydrocracking process described as directed to the production of lubricating oils. In this process two relatively heavy feed streams are passed into separate hydrocracking reactors. It does not appear that any higher boiling hydrocarbon material is recycled to either reactor although the complicated effluent separation and product recovery section of the process is highly integrated.

U.S. Pat. No. 5,228,979 issued to J. W. Ward is directed to a hydrocracking process employing a catalyst containing Beta zeolite. This patent describes the activity reducing effect of ammonia on traditional Y zeolite containing catalysts.

BRIEF SUMMARY OF THE INVENTION

The invention is a single-stage hydrocracking process which allows typical charge stocks to be processed at a overall lower pressure and hence at a lower new unit capital cost. In the subject process the total hydrocarbon input to the process is split between two reaction zones based upon the relative volatility of the components of this input. The entire effluent of both reaction zones is preferably passed into a common separation and recovery section. All of the "unconverted" material recovered from the recovery section is recycled into the hydrocracking zone receiving the lightest portion of the overall feed. The subject process can provide a cost reduction compared to processing the entire feed stream in a single hydrocracking zone or commingling a light and a heavy feed stream and then processing this admixed feed stream in a single higher pressure processing train. The invention also provides certain operational advantages.

One broad embodiment of the invention may be characterized as a process which comprises the steps of dividing a hydrocracking process feed stream into a first feed stream and a second feed stream which is easier to convert due to a lower nitrogen content, and contacting the first feed stream and hydrogen with a first bed of hydrocracking catalyst maintained at hydrocracking conditions in a first hydrocracking reaction zone and achieving at least 60 volume percent conversion of the first feed stream; contacting the second feed stream, in admixture with hydrogen, with a second bed of hydrocracking catalyst maintained at hydrocracking conditions in a second hydrocracking reaction zone which conditions include substantially the same pressure as maintained in the first hydrocracking zone, but which result in a higher rate of overall conversion than in the first hydrocracking zone; passing the effluent of the first hydrocracking reaction zone and the effluent of the second hydrocracking reaction zone into a common vapor-liquid separation zone, removing a hydrogen-rich vapor phase process stream and a liquid phase process stream from the vapor-liquid separation zone; recycling at least a portion of the vapor phase process steam to a hydrocracking reaction zone; passing the liquid phase process stream into a fractionation zone, and recovering a distillate boiling range product stream and a hydrocarbon recycle stream comprising unconverted hydrocarbons; and, passing the hydrocarbon recycle stream into the second hydrocracking reaction zone. Preferably a "drag stream" of heavy but valuable hydrocarbons classified on the basis of boiling point as unconverted hydrocarbons is also recovered from the fractionation zone and removed from the process.

BRIEF DESCRIPTION OF THE DRAWING

The Drawing illustrates a hydrocracking process in which the process feedstream of line 1 is divided into light and heavy fractions which are respectively passed into recycle hydrocracking reactor 9 and once-through hydrocracking reactor 14. The entire recycle stream of unconverted chargestock carried by line 7 also being passed into reactor 9, which receives the light feed fraction.

DETAILED DESCRIPTION AND PREFERRED EMBODIMENTS

When designing a hydrocracking process it is generally considered prudent to minimize the number of major reaction vessels and associated equipment such as compressors in order to minimize the capital costs of the processing unit. For instance, one piece thick-walled, e.g., 12–20 inch thick, stainless steel reactor vessels are major cost components of a hydrocracking process unit. They are also extremely heavy, especially when loaded with catalyst and oil, and their weight poses major design limitations. The cost of piping and other vessels such as separators present in a reactor train also tend to make minimizing the number of vessels a major design consideration. For this reason it has been common practice to blend any available feed streams into a single overall process input stream and charge this single stream to a single reactor train if a single train could process the total amount of material. This is usually possible at total hydrocarbon input rates up to about 60,000 barrels per stream day (BPSD).

As used herein a "reactor train" is considered to include the fired heater upstream of the reactor plus the heat exchangers and separation vessels between the reactor and the downstream product fractionation column It is an objective of the subject invention to provide a lower cost recycle hydrocracking process for processing very large feed stream flow rates. It is a specific objective of the invention to provide a hydrocracking process having only a single "train" of equipment downstream of the reaction zone. It is a further objective to provide a hydrocracking process flow which allows processing at a relatively high feed rate in a revamped unit which employs existing reactors.

These objectives are met through the use of a unique flow scheme in which a single fresh feed stream is split into two portions which differ in their ease of conversion, with each portion being passed directly into a separate reaction zone. In a variation a first fresh feed stream is divided into the two different fractions and then a second fresh feed stream having a similar processability is admixed with one of the fractions. The subject process is therefore distinguished by this division of a single process feed stream into two smaller feed streams of differing composition which are passed into separate reaction zones. The process is further distinguished by the fact that no hydrocarbon removed from the once-through reaction zone is passed into the other reaction zone without having first passed through the effluent separation and product recovery facilities. All of the hydrocarbon feed to the process is passed into the initial reactors of the reaction zones, thus distinguishing it from flow schemes having sequential addition of feed at different points in the reaction zone. Another distinguishing feature is that a recycle stream of unconverted feed hydrocarbons removed from a product recovery column is passed into only one of the reaction zones. Other distinguishing points include the relative conversion in the two reaction zones and the passage of the recycle stream into the high conversion reactor processing the lighter feed fraction.

The initial step in the subject process is the division of the process feed stream into a light fraction and a heavy fraction. One characteristic of this initial division of the process feed stream is that the entire stream is divided into just two fractions These fractions become the feed streams for the two hydrocracking reaction zones. The terms "light" and "heavy" are used in their normal sense within the refining industry to refer respectively to relatively low and high boiling point ranges. This separation according to boiling point range also concentrates the compounds having a higher nitrogen content into the heavy fraction. This initial separation step is distinguishable from the separation performed in a crude column on a full boiling range feed by the relatively limited boiling point range of the feed to the process. This feed stream is equivalent to the feed to a conventional hydrocracking process and therefore has a limited boiling point range. It will consist primarily of hydrocarbonaceous compounds having boiling points above the normal light and middle distillate products such as naphtha and kerosene. This may be expressed in terms of the 5% (vol.) boiling point of the feed stream as determined by the appropriate ASTM distillation procedure. The process feed stream should have a 5% boiling point above 350° F. (177° C.) and preferably above 400° F. (204° C.). Therefore substantially all (at least 90 vol. %) of the process feed stream will fall within the boiling point range between about 300° F. and 1050° F. and preferably between 350° F. and 950° F.

The hydroprocessing of feeds containing nitrogenous compounds results in the formation of ammonia. The basicity and size of ammonia cause it to reduce the activity of the acidic hydrocracking catalysts. As ammonia is produced within the catalyst bed itself, the gas passing through the great bulk of the catalyst will have a significant ammonia content which will reduce the average activity of the catalyst loaded in the reaction zone.

The customary response to a decrease in catalyst activity brought about by ammonia is to increase either or both the temperature and hydrogen partial pressure of the reaction zone. An increase in temperature usually is limited by such factors as the metallurgy of the reactors and negative effects on catalyst selectivity. The primary response to a high nitrogen content in the feed has therefore been to increase the hydrogen partial pressure and therefore the total operating pressure in the reaction zone. This significantly increases the capital costs of the entire process unit as all parts of the unit upstream of the fractionation columns must be designed to handle an increased pressure. The increased pressure can also increase the operational costs of the process. It is therefore another objective of the subject invention to provide a lower cost method of processing fresh feed streams having relatively high nitrogen contents.

A very simplified example of the subject process can be based upon a refinery having a potential feed made up of a mixture of atmospheric and vacuum gas oils (AGO and VGO). The VGO contains 1700 ppm nitrogen and has a 1050° F. endpoint while the AGO has only 400 ppm nitrogen and a 750° F. endpoint. It is estimated that a conventional full conversion recycle process would require a hydrogen partial pressure of 1800–2000 psig in order to achieve a two-year cycle. This estimate is based upon commercial experience. By dividing the feed and processing the VGO fraction in a parallel once-through hydrocracking reaction zone, the overall unit pressure can be reduced by approximately 300 psig. The ammonia content of the recycle gas of the AGO recycle mode hydrocracking reactor would drop by a factor of about four and catalyst activity in this reactor zone would greatly increase.

While much of the discussion herein will refer to processing a lighter and a heavier feed fraction, it must be kept in mind that the relative boiling points of the hydrocarbons is only indicative of their relative processability and other factors such as nitrogen, sulfur or aromatic content of a particular feed stream may well outweigh boiling point in determining which feed stream is easier to process. The true measure of which feed or fraction is easier to process is more accurately given by a comparison of the temperature required to process the two feed streams using the same catalyst operated at the same conditions such as liquid hourly space velocity and hydrogen partial pressure.

Both of the reaction zones employed in the subject process must operate with a significant level of conversion of entering feed components into distillate products. These "distillates" are normally sidecuts of a product fractionation column and include naphtha, kerosene and diesel fractions. The term "conversion" as used herein refers to the chemical change necessary to allow the product hydrocarbons to be removed in one of the distillate product streams of the process withdrawn from the product recovery zone. Hydrocarbons removed from the bottom of the product recovery column as a drag stream may be a high value product as disclosed herein but are not considered to be either distillates or conversion products for purposes of this definition of conversion. This definition provides for the inherent variation in feeds and desired products which exists between different refineries. Typically, this definition will require the production of distillate hydrocarbons having a boiling points below about 700° F. (371° C.).

Each reaction zone should be designed and operated to achieve at least a 40 volume percent conversion of feed compounds boiling above the maximum desired product boiling point. The conversion level in each reaction zone should be in the general range of from about 40 to about 95 percent. Preferably, the conversion level in the once-through reaction zone is above 60 percent and more preferably the conversion level is above 70 percent. The conversion level in the once-through reaction zone, processing the heavy feed, is lower than in the recycle reaction zone processing the light feed. A maximum of 90% conversion is desired in the once-through reactor, with conversions in the range of 60–90 volume percent being preferred. The conversion level in the recycle reactor, processing the light feed, should be above 90 volume percent and preferably is above 95%. The conversion level in the recycle reaction zone is preferably 10 percent greater than the conversion level in the once-through reaction zone.

In a representative example of a conventional hydrocracking process, a heavy gas oil is charged to the process and admixed with any hydrocarbon recycle stream. The resultant admixture of these two liquid phase streams is heated in an indirect heat exchange means and then combined with a hydrogen-rich recycle gas stream. The admixture of charge hydrocarbons, recycle hydrocarbons and fresh hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, reaction by-products such as hydrogen sulfide and ammonia formed by hydrodesulfurization and hydrodenitrification reactions which occur simultaneously with the hydrocracking reaction. The reaction zone effluent will also contain the desired product hydrocarbons boiling in the gasoline, diesel fuel, kerosene or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone and then passed into a vapor-liquid separation zone normally referred to as a high pressure separator. Additional cooling can be done prior to this separation. In some instances a hot flash separator is used upstream of the high pressure separator. The use of "cold" separators to remove condensate from vapor removed from a hot separator is another option. The liquids recovered in these vapor-liquid separation zones are passed into a product recovery zone containing one or more fractionation columns. Product recovery methods for hydrocracking are well known and conventional methods may be employed in the subject invention. In many instances the conversion achieved in the hydrocracking reactor(s) is not complete and some heavy hydrocarbons are removed from the product recovery zone as a "drag stream" which is removed from the process and/or as a recycle stream. The recycle stream is preferably passed into the hydrotreating (first) reactor in a hydrotreating-hydrocracking sequence as this reduces the capital cost of the overall unit. It may, however, sometimes be passed directly into a hydrocracking reactor.

A net drag stream is preferably removed from the subject process. This allows the use of less severe conditions in the reaction zones. The size of the drag stream can be in the broad range of 1–20 volume percent of the process feed stream, but is preferably in the range of 2–10 volume percent.

A "hot" high pressure separator is distinguished in the art from a "cold" high pressure separator by the fact that the process stream entering a cold separator has been cooled by indirect heat exchange against an external coolant stream such as air or cooling water. This is in contrast to some cooling by exchange against process streams upstream of a hot separator performed to recover heat for reuse in the process. The term "high pressure" separator indicates the separator is operated at essentially the operating pressure of the upstream reaction zone minus any inherent pressure drop due to intermediate lines and vessels. Reference may be made to the previously cited text *Hydrocracking Science and Technology* for further information on general hydrocracking process flows.

For the purpose of clarity of presentation, such normal and customary equipment as control valves, sensors, additional separation vessels, the quench streams to the midpoints of hydrocracking reaction zones and other required systems are not illustrated on the drawing.

While not shown on the drawing, it is within the scope of the invention for the one or more reactors of each reaction zone to contain some hydrotreating catalyst. A pretreatment for the removal of sulfur and nitrogen from molecules of the chargestock is sometimes desired upstream of a bed of hydrocracking catalyst. Likewise a small bed of hydrotreating catalyst may be desired as the last catalyst in the reaction zone to reduce the mercaptan content of recovered products. Rather than placing the hydrotreating catalyst in a hydrocracking reactor, it may be preferred to employ a bed of post treating catalyst located downstream of the initial separation of the reaction zones' effluent into vapor and liquid streams. These variations locate the post treating catalyst upstream of any cold separator employed in the process.

Referring now to the drawing a process feedstream, which contains an admixture of the potential feed materials enumerated herein, enters the process through line 1 and is passed into a splitter column 2 in which it is separated by the relative volatilities of its components into a "light" fraction and a smaller "heavy" fraction. The light fraction carried by line 3 is heated by indirect heat exchange in a means not shown such as an exchanger followed by a fired heater as is customary in the art and is admixed with recycle hydrogen from line 5. The light fraction is then passed through line 6 and admixed with the recycle hydrocarbon stream of line 7 before being passed through line 8 into a first hydrocracking zone 9, which can comprise two or more individual reactors. This zone may contain a bed or entire reactor loaded with hydrotreating catalyst. This reaction zone will have intermediate quench streams of hydrogen passed into the hydrocracking zone for purposes of temperature control.

In the reaction zone 9 the entering chargestock and hydrogen are contacted with a suitable hydrocracking catalyst maintained at hydrocracking conditions which affect the conversion of a sizable fraction of the entering hydrocarbonaceous compounds into lower boiling point compounds. The cracking reactions result in the formation of a large variety of different product compounds having different molecular weights and structures ranging from methane up to compounds within the boiling point range of the feedstream. Besides this conversion of charge molecules to lower boiling molecules, the reactions within the hydrocracking reactor result in the removal of sulfur and nitrogen from the entering feed and the resultant production of hydrogen sulfide and ammonia. There is thereby produced a multicomponent reaction zone effluent stream which is removed from hydrocracking reaction zone 9 through line 18. This stream is cooled in a heat exchanger not shown and then passed into a high pressure vapor-liquid separation zone 19.

The customary procedure of injecting water into the effluent of the reaction zone to provide a medium to dissolve salts which would otherwise form from the ammonium and hydrogen sulfide upon the cooling of the reaction zone is practiced in the subject invention. This water injection normally results in the removal of a very large percentage of the ammonia from the reaction zone effluent since there will normally be an excess of hydrogen sulfide. The recycle gas removed from the high pressure separator(s) employed in the process can therefore have a low ammonia concentration. However, the concentration of ammonia in the reactors may be quite high and it is this higher ammonia concentration, which is proportional to the nitrogen content of the feed, that is in part addressed by the subject process.

The ammonia concentration in the reaction zone processing the feed having the higher nitrogen content will increase faster through the reaction zone and reach a higher level. Thus the catalyst in this reaction zone will suffer from a higher degree of acid cite poisoning by ammonia than an equivalent catalyst in the other reaction zone.

The separation zone 19 concentrates the hydrogen present in the reaction zone effluent stream of line 18 into a vapor phase stream carried by line 34. The vapor-phase stream of line 34 may be diverted in part into line 35 or augmented via line 35. This produces the hydrogen recycle stream of line 5. This stream may be passed through an optional hydrogen sulfide removal zone 33 if desired. Makeup hydrogen from lines 10 and/or line 11 is admixed into the reactor feed streams of lines 3 and/or 4 as required to maintain the desired hydrogen partial pressure in the reactors.

The liquid phase hydrocarbons recovered in the high pressure vapor-liquid separators 16 and 19 are passed through lines 17 and 20 respectively and line 21 into a low pressure flash separator 22. The liquid from the flash separator is passed via line 25 into a product recovery fractionation column 26. The fractionation column 26 is designed and operated to separate the entering hydrocarbons based upon their relative volatility into a number of different product streams, a recycle stream and a drag stream. The lightest stream removed from the fractionation column 26 comprises the overhead stream of line 27 which will normally comprise methane through butane with some small amounts of heavier compounds. Also removed from this column will be a stream of naphtha boiling range hydrocarbons carried by line 28, and one or more heavier distillate product streams removed through line 29 and 30 which may be kerosene or diesel fuel boiling range product streams. Also recovered from the bottom of the fractionation column are the recycle stream of line 7 and a stream of unconverted hydrocarbons removed through line 31. This bottoms stream is removed as the drag stream.

While being referred to as "unconverted hydrocarbons", the recycle hydrocarbons of line 7 have been passed through at least one of the hydrocracking zones employed in the process, and therefore have different overall characteristics than the feed stream. The recycle stream may have a reduced content of sulfur and nitrogen compared to the feed stream but will on average be slightly harder to crack than the process feedstream as a result of the remaining unconverted hydrocarbons being richer in cyclic paraffins than the feed. This stream of unconverted material carried by line 7 is combined with the light first fraction of the feedstream and hydrogen and then passed through line 8 into the recycle hydrocracking reaction zone 9.

The smaller heavy fraction of the process feed stream is passed through line 4 and admixed with the optional makeup hydrogen of line 11 and recycle hydrogen-rich gas of line 12. The resultant admixture is heated by means not shown and passed into the low-conversion once-through reactor 14. The reactions performed at hydrocracking conditions in the multiple beds/reactors of this zone produce a second multicomponent broad boiling range reaction zone effluent. This effluent is passed through line 15 into the high pressure separator 16. This separator may be operated at a slightly reduced temperature compared to the reaction zone but is operated close to the pressure of the reaction zone.

The vapor stream removed from separator 16 will contain hydrogen, methane, ethane and other light hydrocarbons plus some ammonia and hydrogen sulfide. A portion of this gas may be passed through optional line 35 if desired to balance gas flows in the process.

An alternative process flow combines the two high pressure separators 16 and 19 into a single separator. This is represented in the drawing by optional line 24, which could be used to direct the effluent of the once-through reactor into the separator of the recycle reactor.

Another alternative shown on the drawing is the passage of the recycle gas streams of lines 5 and 12 through gas treatment zones 32 and/or 33 to remove acid gases. High pressure scrubbing with an amine solution is one possible method of performing this step to remove hydrogen sulfide. As previously mentioned, an additional feed stream carried by optional lines 36 or 37 can be charged to the process if desired. This stream would be matched to the processability of the first or second fraction of the feed stream.

Yet another variation to the process flow comprises using alternative means to separate the incoming process feed stream of line 1. It is not necessary to employ a full splitter column 2 to achieve some of the benefit of the subject invention since a precise split of the incoming feed is not required. One or more flash separators or a recitified flash separator may be able to provide an adequate separation at lower costs. The composition of the feed is a primary variable factor in the selection of equipment for this step.

Suitable feedstocks for the subject process include virtually any heavy hydrocarbonaceous mineral or synthetic oil or a mixture of one or more fractions thereof. Thus, such known feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above about 260° Celsius (500° F.)and does not contain an appreciable concentration of asphaltenes. The feed stream should have a boiling point range falling between 260–5380° C. Preferred first stage feedstocks therefore include gas oils having at least 50% volume of their components boiling above 371° C. (700° F.). The hydrocracking feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %.

The product distribution of the subject process is set by the feed composition and the selectivity of the catalyst(s) at the conversion rate maintained in the reaction zones at the chosen operating conditions. The subject process is especially useful in the production of middle distillate fractions boiling in the range of about 300–700° F. (149–371° C.) as determined by the appropriate ASTM test procedure. These are recovered by fractionating the liquids recovered from the effluent of the reaction zone. The term "middle distillate" is intended to include the diesel, jet fuel and kerosene boiling range fractions. The terms "kerosene" and "jet fuel boiling point range" are intended to refer to a temperature range of 300–550° F. (149–288° C.) and diesel boiling range is intended to refer to hydrocarbon boiling points of about 338–about 700° F. (170–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary depending on such factors as the characteristics of the crude oil source, the refinery's local markets, product prices, etc. Reference is made to ASTM standards D-975 and D-3699-83 for further details on kerosene and diesel fuel properties and to D-1655 for aviation turbine feed.

Hydrocracking conditions employed in the subject process are those customarily employed in the art for hydrocracking. Hydrocracking reaction temperatures are in the broad range of 400° to 1200° F. (204–649° C.), preferably between 600° and 950° F. (316–510° C.). Reaction pressures are preferably between about 1000 and about 3000 psi (13,780–24,130 kPa). A temperature above about 316° C. and a total pressure above about 8270 kPa (1200 psi) are highly preferred. Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8,888 std. $m^3/m^3$), preferably between 2,000 and 30,000 scf per barrel of charge (355–5,333 std. $m^3/m^3$).

Suitable catalysts for use in all reaction zones of this process are available commercially from a number of vendors including UOP, Haldor-Topsoe and Criterion Catalyst Company. It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The matrix may comprise any known refractory inorganic oxide such as alumina, magnesia, silica, titania, zirconia, silica-alumina and the like and preferably comprises a combination thereof such as alumina and silica-alumina. It is preferred that the support comprises from about 5 wt. % to about 45 wt. % alumina. The most preferred matrix comprises a mixture of silica-alumina and alumina wherein the silica-alumina comprises between 15 and 85 wt. % of said matrix.

A Y zeolite has the essential X-ray powder diffraction pattern set forth in U.S. Pat. No. 3,130,007. The as synthesized zeolite may be modified by techniques known in the art which provide a desired form of the zeolite. Thus, modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. The Y zeolites marketed by UOP of Des Plaines, Ill. under the trademarks Y-82, Y-84, LZ-10 and LZ-20 are suitable zeolitic starting materials. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

The silica-alumina component of the hydrocracking or hydrotreating catalyst may be produced by any of the numerous techniques which are well described in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier commonly defined in terms of surface area, pore diameter and pore volume, may be developed to specified limits by any suitable means including aging a hydrosol and/or hydrogel under controlled acidic or basic conditions at ambient or elevated temperature.

An alumina component of the catalysts may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The finished catalysts for utilization in the subject process should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/g$ are greatly preferred.

The composition and physical characteristics of the catalysts such as shape and surface area are not considered to be limiting upon the utilization of the present invention. The catalysts may, for example, exist in the form of pills, pellets, granules, broken fragments, spheres, or various special shapes such as trilobal extrudates, disposed as a fixed bed within a reaction zone. Alternatively, the hydrocracking catalyst may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow.

The catalyst particles may be prepared by any known method in the art including the well-known oil drop and extrusion methods. A preferred form for the catalysts used in the subject process is an extrudate. The well-known extrusion method involves mixing the molecular sieve, either before or after adding metallic components, with the binder and a suitable peptizing agent to form a homogeneous dough or thick paste having the correct moisture content to allow for the formation of extrudates with acceptable integrity to withstand further handling and subsequent calcination. Extrudability is determined from an analysis of the moisture content of the dough, with a moisture content in the range of from 30 to 50 wt. % being preferred. The dough then is extruded through a die pierced with multiple holes and the spaghetti-shaped extrudate is cut to form particles in accordance with techniques well known in the art. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

A spherical catalyst may be formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. The resulting aged and gelled particles are then washed and dried at a relatively low temperature of about 50–200° C. and subjected to a calcination procedure at a temperature of about 450–700° C. for a period of about 1 to about 20 hours. This treatment effects conversion of the hydrogel to the corresponding alumina matrix. The zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos. 3,929,672; 4,422,959; 4,576,711; 4,661,239; 4,686,030; and, 4,695,368 which are incorporated herein by reference.

Hydrogenation components contemplated for use in the catalysts are those catalytically active components selected from the Group VIB and Group VIII metals and their compounds. References herein to Groups of the Periodic Table are to the traditionally American form as reproduced in the fourth edition of *Chemical Engineer's Handbook*, J. H. Perry editor, McGraw-Hill, 1963. Generally, the amount of hydrogenation components present in the final catalyst composition is small compared to the quantity of the other above-mentioned support components. The Group VIII component generally comprises about 0.1 to about 30% by weight, preferably about 1 to about 20% by weight of the final catalytic composite calculated on an elemental basis. The Group VIB component of the hydrocracking catalyst comprises about 0.05 to about 30% by weight, preferably about 0.5 to about 20% by weight of the final catalytic composite calculated on an elemental basis. The total amount of Group VIII metal and Group VIB metal in the finished catalyst in the hydrocracking catalyst is preferably less than 21 wt. percent. The hydrogenation components contemplated for inclusion in the catalyst include one or more metals chosen from the group consisting of molybdenum, tungsten, chromium, iron, cobalt, nickel, platinum, palladium, iridium, osmium, rhodium, ruthenium and mixtures thereof. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrotreating catalyst. If used phosphorus is normally present in the catalyst in the range of 1 to 30 wt. % and preferably 3 to 15 wt. % calculated as $P_2O_5$.

The invention may be characterized as a process comprising the steps of dividing a hydrocracking process feed stream into a larger light first fraction and a smaller heavy second fraction, passing the first fraction and hydrogen into a first hydrocracking zone comprising a first bed of hydrocracking catalyst maintained at hydrocracking conditions and generating a first effluent stream; passing the second fraction and hydrogen into a second hydrocracking zone comprising a second bed of hydrocracking catalyst maintained at hydrocracking conditions, which conditions include substantially the same pressure as maintained in the first hydrocracking zone, but which result in a lower overall conversion than in the first hydrocracking zone, and generating a second effluent stream; subjecting both the first and the second effluent streams to vapor-liquid separation, recovering a vapor phase process stream from this vapor-liquid separation, and returning at least a portion of the vapor phase process stream to the first or second hydrocracking zone as a recycle gas stream; passing liquid phase hydrocarbons recovered during said vapor-liquid separation of the first and second effluent streams into a single fractionation zone wherein the liquid phase hydrocarbons are separated and thereby producing at least a distillate boiling range product stream, a hydrocarbon recycle stream comprising unconverted hydrocarbons and a cyclics rejection stream, which is removed from the process; and, passing the hydrocarbon recycle stream into the first hydrocracking reaction zone.

An alternative embodiment of the invention may accordingly be characterized as a hydrocracking process which comprises the steps of dividing a hydrocracking process feed stream into a first fraction and a smaller volume second fraction, which second fraction has an average boiling point at least 50 F. degrees above the average boiling point of the first fraction; passing the second fraction and hydrogen into a once-through first hydrocracking zone comprising a first bed of hydrocracking catalyst maintained at hydrocracking conditions which result in at least 80 vol. percent conversion and generating a first effluent stream; passing the first fraction and hydrogen into a second hydrocracking zone comprising a second bed of hydrocracking catalyst maintained at hydrocracking conditions which include substantially the same pressure as maintained in the first hydrocracking zone but which result in a greater overall conversion than in the first hydrocracking zone, and generating a second effluent stream; passing the first and the second effluent streams into a vapor-liquid separation zone, and removing a vapor phase process stream and a liquid phase process stream from the vapor-liquid separation zone; recycling at least a portion of the vapor phase process stream; passing the liquid phase process stream into a fractionation zone wherein the liquid phase process stream is separated and thereby producing at least a distillate boiling range product stream, a hydrocarbon recycle stream, which comprises unconverted hydrocarbons, and a cyclics rejection stream, which is removed from the process; and, passing the hydrocarbon recycle stream into the second hydrocracking reaction zone.

What is claimed:

1. A hydrocracking process, which process comprises the steps of:

a.) dividing a hydrocracking process feed stream into a larger light first fraction and a smaller heavy second fraction, b.) passing the first fraction and hydrogen into a first hydrocracking zone comprising a first bed of hydrocracking catalyst maintained at hydrocracking conditions and generating a first effluent stream;

c.) passing the second fraction and hydrogen into a second hydrocracking zone comprising a second bed of hydrocracking catalyst maintained at hydrocracking conditions, which conditions include substantially the same pressure as maintained in the first hydrocracking zone but which result in a lower overall conversion than in the first hydrocracking zone, and generating a second effluent stream;

d.) subjecting both the first and the second effluent streams to vapor-liquid separation, recovering a vapor phase process stream from this vapor-liquid separation, and returning at least a portion of the vapor phase process stream to the first or second hydrocracking zone as a recycle gas stream;

e.) passing liquid phase hydrocarbons recovered during said vapor-liquid separation of the first and second effluent streams into a single fractionation zone wherein the liquid phase hydrocarbons are separated and thereby producing at least a distillate boiling range product stream, a hydrocarbon recycle stream comprising unconverted hydrocarbons and a cyclics rejection stream, which is removed from the process; and, f.) passing the hydrocarbon recycle stream into the first hydrocracking reaction zone.

2. The process of claim 1 wherein the first and the second effluent streams are passed into separate vapor-liquid separation zones, with separate recycle gas streams being produced for each hydrocracking zone.

3. The process of claim 1 wherein the same catalyst is present in the first and second beds of hydrocracking catalyst.

4. The process of claim 1 wherein the conversion rate in the second hydrocracking reaction zone is between 60 and 90 volume percent.

5. The process of claim 4 wherein the conversion rate in the first hydrocracking reaction zone is 10 percent greater than the conversion in the second reaction zone.

6. The process of claim 5 wherein the first and second effluent streams are passed into separate high pressure vapor-liquid separators and liquid removed from the separate high pressure separators is passed into a common lower pressure vapor-liquid separation vessel.

7. A hydrocracking process, which process comprises the steps of:

a.) dividing a hydrocracking process feed stream into a first fraction and a smaller volume second fraction, which second fraction has an average boiling point at least 50 F. degrees above the average boiling point of the first fraction;

b.) passing the second fraction and hydrogen into a once-through first hydrocracking zone comprising a first bed of hydrocracking catalyst maintained at hydrocracking conditions which result in at least 80 vol. percent conversion and generating a first effluent stream;

c.) passing the first fraction and hydrogen into a second hydrocracking zone comprising a second bed of hydrocracking catalyst maintained at hydrocracking conditions which include substantially the same pressure as maintained in the first hydrocracking zone, but which result in a greater overall conversion than in the first hydrocracking zone, and generating a second effluent stream;

d.) passing the first and the second effluent streams into a vapor-liquid separation zone, and removing a vapor phase process stream and a liquid phase process stream from the vapor-liquid separation zone;

e.) recycling at least a portion of the vapor phase process stream to the second hydrocracking zone;

f.) passing the liquid phase process stream into a fractionation zone wherein the liquid phase process stream is separated and thereby producing at least a distillate boiling range product stream, a hydrocarbon recycle stream, which comprises unconverted hydrocarbons, and a cyclics rejection stream, which is removed from the process; and, g.) passing the hydrocarbon recycle stream into the second hydrocracking reaction zone.

8. The process of claim 7 wherein the first and the second effluent streams are passed into separate vapor-liquid separation zones, with separate recycle gas streams being produced for each hydrocracking zone.

9. The process of claim 7 wherein a second hydrocarbon feed stream is passed into the second hydrocracking zone.

10. The process of claim 7 wherein substantially all of the hydrocracking process feed stream falls within a boiling point between about 300° F. and 1100° F.

11. The process of claim 7 where the hydrocracking process feed stream has a 5% boiling point above 400° F.

12. A hydrocracking process which comprises the steps:

a.) dividing a hydrocarbon feed stream into a first feed stream and a second, easier-to-convert, feed stream having a lower nitrogen content;

b.) contacting the first feed stream and hydrogen with a first bed of hydrocracking catalyst maintained at hydrocracking conditions in a first hydrocracking reaction zone and achieving at least 60 volume percent conversion of the first feed stream;

c.) contacting the second feed stream, in admixture with hydrogen, with a second bed of hydrocracking catalyst maintained at hydrocracking conditions in a second hydrocracking reaction zone, which second hydrocracking reaction zone is operated at a higher rate of conversion than in the first hydrocracking zone;

d.) passing the effluent of the first hydrocracking reaction zone and the effluent of the second hydrocracking reaction zone into a vapor-liquid separation zone, removing a hydrogen-rich vapor phase process stream and a liquid phase process stream from the vapor-liquid separation zone;

e.) recycling at least a portion of the vapor phase process steam to a hydrocracking reaction zone;

f.) passing the liquid phase process stream into a fractionation zone, and recovering a distillate boiling range product stream and a hydrocarbon recycle stream comprising unconverted hydrocarbons; and, g.) passing the hydrocarbon recycle stream into the second hydrocracking reaction zone.

* * * * *

UNITED STATES PATENT AND TRADEMARK OFFICE
CERTIFICATE OF CORRECTION

PATENT NO.: 6,113,775
DATED: September 5, 2000
INVENTORS: Ben A. Christolini et al.

It is certified that error appears in the above-identified patent and that said Letters Patent is hereby corrected as shown below:

In the title, "End" should be replaced with "Feed."

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*